United States Patent [19]

Best

[11] Patent Number: 4,628,719

[45] Date of Patent: Dec. 16, 1986

[54] PULLER APPARATUS

[75] Inventor: Richard L. Best, Lowellville, Ohio

[73] Assignee: R. L. Best Company, Inc., Youngstown, Ohio

[21] Appl. No.: 686,841

[22] Filed: Dec. 27, 1984

[51] Int. Cl.[4] ..... B21C 35/02

[52] U.S. Cl. ..... 72/257; 104/94

[58] Field of Search ..... 72/257, 290, 291; 104/94; 191/45 A; 212/205

[56] References Cited

U.S. PATENT DOCUMENTS

| | | | |
|---|---|---|---|
| 481,349 | 8/1892 | Ferris . | |
| 1,178,196 | 4/1916 | Willard . | |
| 1,347,482 | 7/1920 | Bartlett et al. | 104/94 |
| 2,725,973 | 12/1955 | King | 104/94 |
| 3,101,677 | 8/1963 | Ehinger | 104/91 |
| 3,230,753 | 1/1966 | Walker | 72/257 |
| 3,525,306 | 8/1970 | Edel et al. | 104/95 |
| 3,855,937 | 12/1974 | Caudill | 104/94 |
| 3,881,339 | 5/1975 | Mannell | 72/257 |
| 4,000,702 | 1/1977 | Mackintosh | 104/244 |
| 4,307,597 | 12/1981 | Elhaus | 72/257 |

*Primary Examiner*—Lowell A. Larson
*Attorney, Agent, or Firm*—Luedeka & Neely

[57] ABSTRACT

The specification discloses a puller apparatus for pulling an extrusion profile as it emerges from an extruder. A puller carriage is mounted for rolling motion beneath a track which extends away from the extruder and a puller jaw is located on the front of the carriage for grasping the extrusion profile to be pulled. The track includes two spaced apart, opposed, parallel rails extending parallel to the track. An upwardly and inwardly facing running surface is formed on each rail. Inclined wheels are rotatably attached to the carriage and are configured to engage and roll on the running surfaces of each rail so that as the profile is being pulled away from the extruder, the inclined wheels transmit to the running surfaces downward, upward and lateral forces which occur during the extrusion process. Thusly configured, upward, downward and lateral movement of the carriage relative to the extruder is substantially reduced or eliminated during the pulling process thereby preventing undesirable twisting or bending of the profile as it cools.

28 Claims, 5 Drawing Figures

PULLER APPARATUS

The present invention relates to a puller apparatus and more particularly relates to a puller for pulling an extrusion profile as it emerges from an extruder having structure for reducing or eliminating undesirable movement of the puller carriage relative to the extruder.

In the prior art, it has been found necessary to exert a constant tension on the profile as it emerges from the extruder. This requirement relates generally to avoiding undesirable twisting and bending of the profile during pulling which, if it occurred, would result in substantial reworking of the profile or possibly scapping of the profile altogether.

A puller of this type is shown in U.S. Pat. Nos. 3,881,339 and 4,307,597, both of which show a puller carriage movably mounted on a rail. In these devices, as with others in the prior art, wheels have been employed to allow movement of the carriage on a rail or track. Both of the above devices require placing the puller jaw away from and above the puller carriage requiring an extending arm or support for holding the jaw in position. Such devices, by virtue of their configurations, create horizontal and vertical torques on the carriage which makes it difficult to hold the profile steady while it is being pulled. To compensate therefor, it has become necessary in some devices to employ elaborate stabilizing structures and supports extraneous to the carriage and track or rail, especially where larger profiles are being extruded where the internal twisting and bending forces tend to become substantial.

A need has thus arisen for a puller apparatus capable of of pulling an extrusion profile from an extruder which eliminates or substantially reduces undesirable movement of the puller carriage relative to the extruder, which does not entail the use of extraneous stabilizing means, and which efficiently and symmetrically transmits upward, downward and lateral forces from the profile to the track with a minimum number of moving parts thereby reducing the overall wearing of parts in the apparatus.

The present invention solves the foregoing and other problems long associated with extrusion profile pullers by providing a track and a carriage mounted for movement thereon with structure to prevent slippage or undesirable movement of the carriage relative to the extruder while a profile is being pulled and to efficiently and symmetrically transmit upward, downward and lateral forces from the profile to the rail.

In accordance with the present invention, a puller apparatus for pulling an extrusion profile as it emerges from an extruder is provided including a track extending away from the extruder in a direction generally parallel to the extruder profile. Two rails are formed on the track in a spaced apart, opposed, parallel relationship, each of the rails extending parallel to the track. An upwardly and inwardly facing running surface is formed on each rail for bearing a load and at least one wheel is configured to engage and roll on each of the and roll on each of the running surfaces. A puller carriage is carried by the wheels for rolling motion along the track and a puller jaw is mounted on the carriage for grasping and pulling the extrusion profile as it emerges from the extruder. A chain is provided for urging and translating the carriage along the track whereby the puller jaw grasps the extrusion profile and the carriage is translated along the track away from the extruder to pull the extrusion profile as it emerges from the extruder. In this manner, undesirable movement of the carriage relative to the extruder is substantially reduced or eliminated.

In accordance with another aspect of the present invention, a puller apparatus includes a generally horizontal track extending away from the extruder in a direction parallel to an extrusion profile. The track includes two track units each of which is a mirror image of the other, the track units being mounted in a parallel side-by-side adjacent relationship to form the track. A rail is formed on each track unit, the rails being formed in a spaced apart, opposed, parallel relationship and extending parallel to the track. A running surface is formed on each rail for bearing a load, each running surface having a semi-cylindrical peripheral surface facing upwardly and inwardly and extending along the length of the rail. A puller carriage is mounted for motion along the track and has a puller jaw mounted thereon for grasping and pulling the extrusion profile as it emerges from the extruder. A continuous chain urges and translates the puller carriage along the track whereby the puller grasps the extrusion profile and the carriage is translated along the track away from the extruder to pull the extrusion profile as it emerges from the extruder. As the carriage moves along the track away from the extruder, upward, downward and lateral forces are transmitted to the running surfaces.

In accordance with yet another aspect of the invention, a track extends away from the extruder in a direction parallel to the extrusion profile. The track includes two spaced apart, opposed, and parallel rails which extend parallel to the track, each rail having an upwardly and inwardly facing semi-cylindrical convex running surface formed thereon with its curvature facing upwardly and inwardly. Two wheel pairs are configured and disposed to engage and roll on the running surfaces. A puller carriage is carried by the wheels for rolling motion along the track and has a puller jaw mounted thereon for grasping and pulling the extrusion profile as it emerges from the extruder. A continuous chain urges and translates the carriage along the track to pull the extrusion profile as it emerges from the extruder. In such a manner, undesirable movement relative to the extruder is substantially reduced or eliminated while upward, downward and lateral forces are symmetrically transmitted from the wheels to the running surfaces.

The advantages and further aspects of the present invention will be readily appreciated by those of ordinary skill in the art as the same becomes better understood by reference to the following detailed description when considered in conjunction with the accompanying drawings in which.

Figure 1:
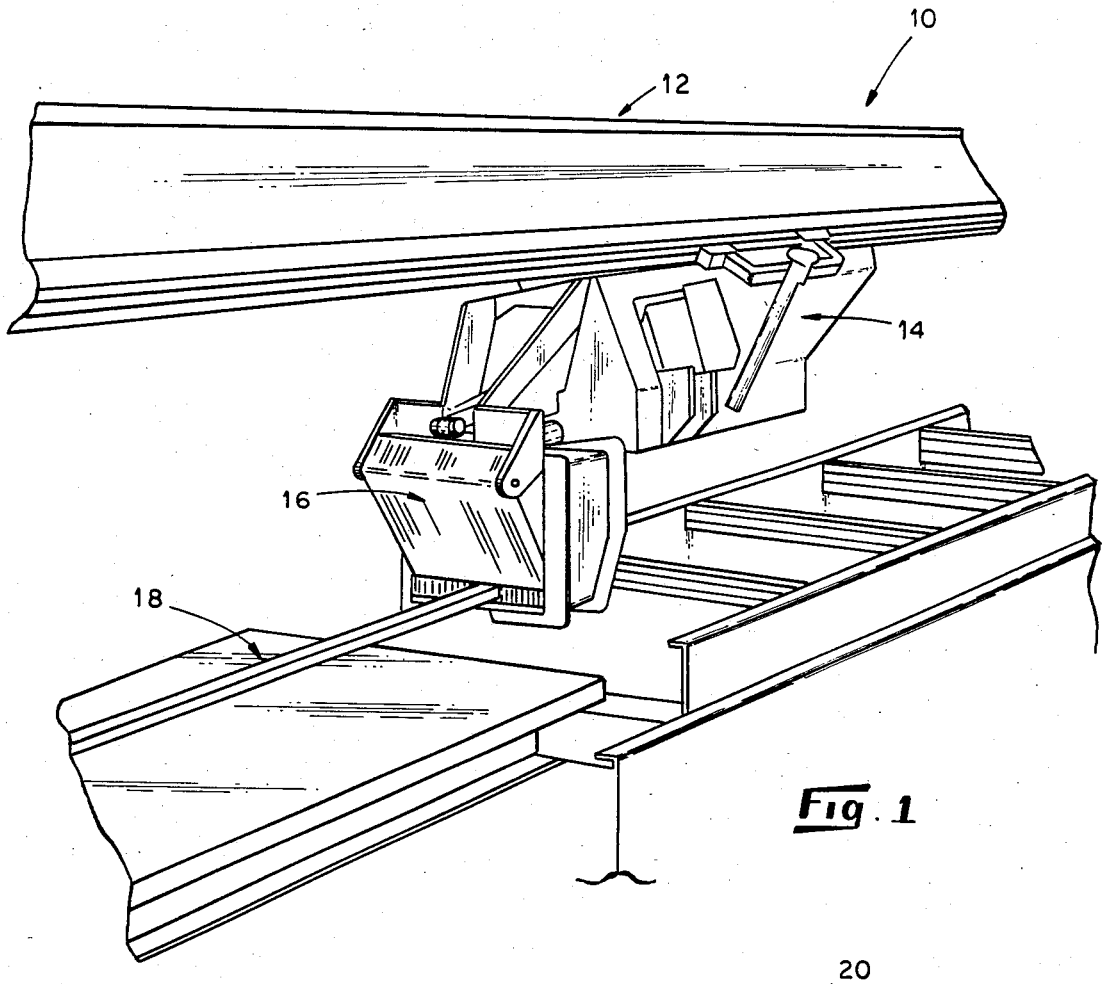
FIG. 1 is an elevational perspective view illustrating one embodiment of the present invention and the orientation of the carriage and puller jaw relative to the track and the extrusion profile.

Referring now to the drawings in which like reference characters refer to like or similar parts throughout the several views, there is shown in FIG. 1 a puller apparatus 10 embodying one form of the present invention. The puller 10 includes a horizontal track 12, a puller carriage 14 mounted for rolling motion below the track 12 and a puller jaw 16 mounted on the lower front part of the puller carriage 14 for grasping pulling an extrusion profile 18 as it emerges from an extruder.

The puller carriage 14 is preferably mounted for rolling motion below the track 12 by inwardly inclined pairs of wheels 20 such as those shown in FIG. 2, which is a perspective view of the carriage 14 removed from the track 12 (the wheels 20 are not visible in FIG. 1). Referring to FIG. 3, the wheels 20 are shown riding on first and second inclined rails 22 and 24 which are part of the track 12 (shown from the outside only in FIG. 1). As can be seen in FIG. 3, and more particularly in the embodiment shown in FIG. 4, the wheels 20 are preferably configured to ride on inclined convex running surfaces 26 and 28 of each rail 22 and 24. Thusly mounted, the wheels 20 transmit to the track 12 upward, downward and lateral forces which result from pulling the extrusion profile 14 as it emerges from the extruder. The angle of the rails 22 and 24 and the wheels 20, and the mating of the inclined convex running surfaces 26 and 28 of the rails 22 and 24 with the concave peripheral surfaces 30 of the wheels 20 prevents slippage of the wheels 20 on the rails 22 and 24 or twisting of the carriage 14 relative to the extruder.

It is to be noted that extrusion profiles often emerge from the extruder with internal forces tending to cause bending or twisting of the profile. It therefore becomes necessary to grasp and pull the profile as it emerges from the extruder maintaining a certain amount of tension on the profile while it cools to prevent warping or twisting. These warping or twisting forces are thereby translated to the puller apparatus. The present invention performs this function of pulling an extrusion profile by providing a rolling puller carriage 14 mounted on a track 12 capable of maintaining the required tension on the profile 18 and preventing undesirable deformation of the profile 18 as it emerges from the extruder. This beneficial result is accomplished, in part, by the unique method of mounting the puller carriage 14 for movement on the track 12 which will be described in more detail below.

Figure 5:
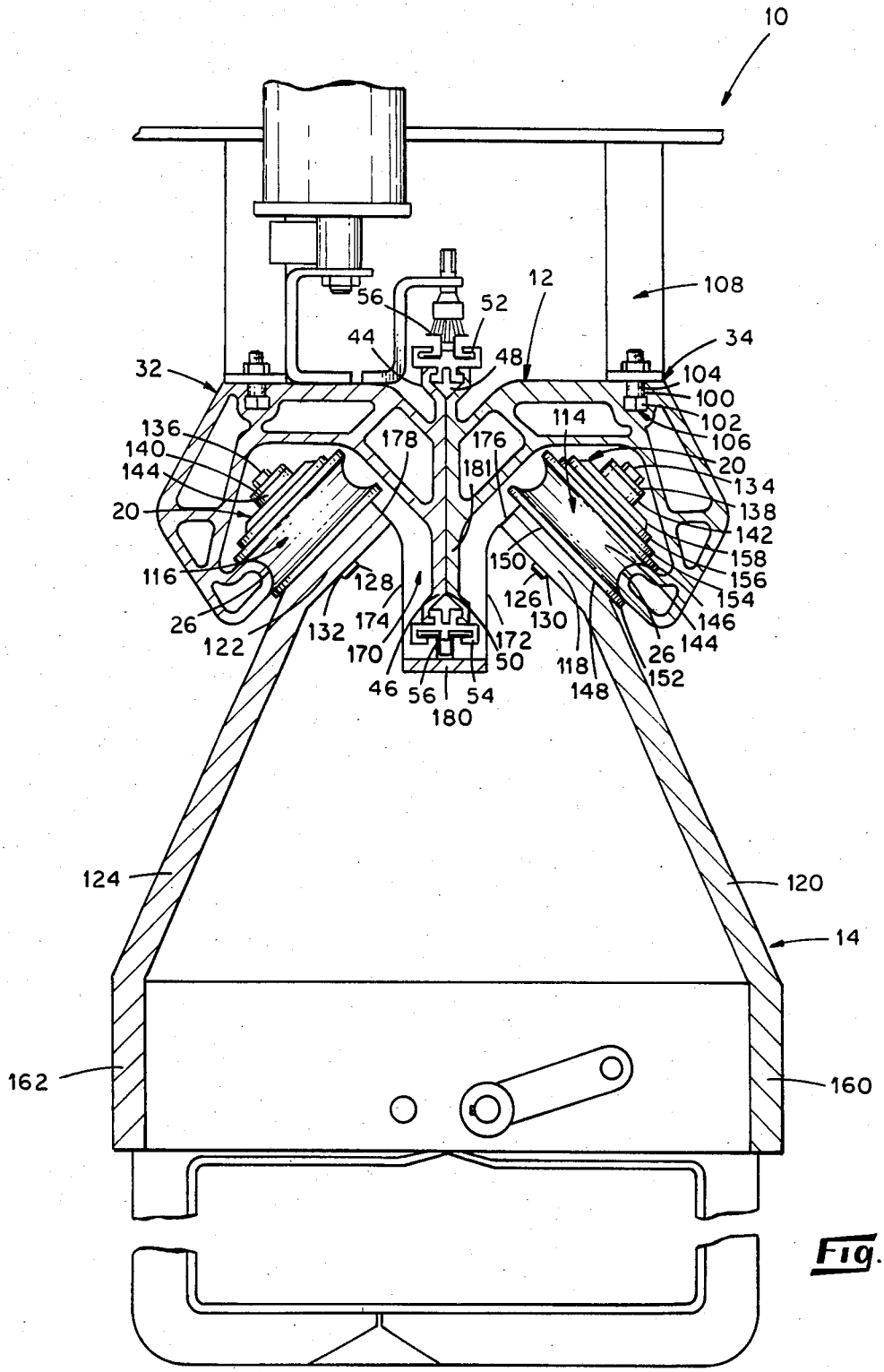
FIG. 5 is a fragmentary front view partially in section illustrating the two track units with the carriage mounted thereon by a pair of inclined wheels.

Referring to FIG. 5, where one form of the puller apparatus 10 is shown in cross section, the track 12 includes first and second track units 32 and 34, the track units 32 and 34 being mirror images of each other and extending along the length of the track 32. The track units 32 and 34 are attached one to the other at their inner surfaces to form the track 12. Since the track units 32 and 34 are identical the following description of the first track unit 32 applies equally to the second track unit 34.

Figure 4:
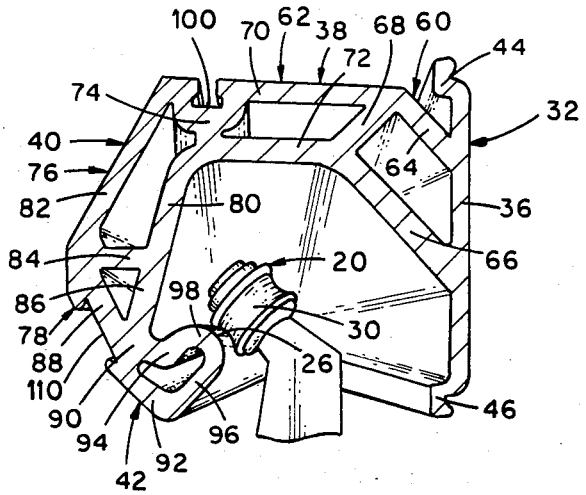
FIG. 4 is a fragmentary front view illustrating in perspective one of the track units and the running surface which is formed on the rail of the track unit.

Referring to FIG. 4 in conjunction with FIG. 5, the track unit 32 includes a center upright plate 36, a transverse beam 38, an outer beam 40, and a rail 42.

The center upright plate 36 extends along the length of the track 12. Inwardly facing upper and lower curls 44 and 46 are formed at the top and the bottom, respectively, of the upright plate 36. The curls 44 and 46 are configured so that when the first and second track units are attached to form the track 12, upper and lower mounting tracks 48 and 50 are formed for receiving upper and lower chain drive channels 52 and 54 located in the upper and lower mounting tracks 48 and 50, respectively. The upper and lower chain drive channels 52 and 54 receive a continuous chain 56 which moves through the channels 52 and 54. The chain 56 is fixedly attached to the carriage 14 so that as the chain moves, the carriage 14 is urged and translated along the track 12 pulling the profile 18 as it emerges from the extruder.

The transverse beam 38 extends across its width from near the top of the upright plate 36 generally outwardly to the outer beam 40 in a direction generally perpendicular to the upright plate 36 and extends along the length of the track 12. The transverse beam 38 includes a first transverse section 60 and a second transverse section 62. The first transverse section 60 extends widthwise generally upwardly and outwardly from the center upright plate 36, the angle between the first section 60 and the plate 36 being about 45 degrees. The first section 60 includes spaced apart upper and lower rectangular members 64 and 66 which are generally parallel. The first section 60 is enclosed at its inward end by the center upright plate 36 and at its outward end by a first rectangular end member 68 which is generally perpendicular to the upper and lower members 64 and 66. The second transverse section 62 extends widthwise outwardly from the first transverse section 60 and includes spaced apart rectangular upper and lower members 70 and 72 which are generally parallel. The second section 62 is enclosed at its inward end by the first end member 68 and at its outward end by a second end member 74 generally perpendicular to the upper and lower members 70 and 72 of the second section 62.

The outer beam 40 extends across its width from the second end member 74 of the transverse beam 38 generally downwardly and outwardly to the rail 42 and extends along the length of the track 12. The outer beam 40 includes a first outer section 76 and a second outer section 78. The first outer section 76 includes spaced apart inner and outer rectangular members 80 and 82 which diverge slightly in a downwardly and outwardly direction. The first section 76 is enclosed at its top by the second end member 74 of the transverse beam 38 and at its bottom by rectangular lower end member 84 which is approximately perpendicular to the center upright plate 36. The second outer section 78 extends widthwise downwardly from the first outer section 76 and is generally triangular in cross section. The second section 78 includes a rectangular inner side 86 generally coplanar with the inner member 80 of the first outer section 76 and an outer side 88 extending downwardly and inwardly. The inner and outer sides 86 and 88 converge and join together at their bottoms to form a junction 90 which encloses the second outer section 78 at the bottom. The second section 78 is enclosed at its top by the lower end member 84 of the first outer section 76.

The rail 42 extends upwardly and inwardly across its width from the junction 90 and includes a rectangular rail base 92 extending from the junction 90 downwardly and inwardly. The rail base 92 is essentially coplanar with the outer side 88 of the second section 78. A pair of spaced apart generally parallel rail sides 94 and 96 extend upwardly and inwardly from opposite edges of the rail base toward the transverse beam. The rail sides 94 and 96 are inclined upwardly toward the transverse beam such that a line extending outwardly from either side 94 or 96 would make about a 45 degree downwardly directed angle with the center upright plate 36. A semicylindrical running surface member 98 extends widthwise between the rail sides 94 and 96 and forms the upper enclosure of the rail 42. The member 98 is preferably convex towards the center upright plate and located between the rail sides 94 and 96 such that a smooth rounded surface is formed. Thusly configured, the rail provides the upwardly inclined convex running surface 26 extending along each side of the length of the track 12.

The track units 32 and 34 are preferably manufactured using a light weight metal having sufficient strength to withstand the upward, downward, and lateral forces transmitted to them by the wheels 20 during a pulling operation and would preferably be formed using an extrusion process. The various members, sides, ends and junctions described above are of sufficient thickness to likewise withstand such forces. In one form of the invention, a support slot 100 is formed in each track unit 32 and 34 and extends along the length of the track 12. The slot 100 is dimensioned to receive the head 102 and shaft 104 of a plurality of support bolts 106 which are spaced apart along the length of the track 12. The bolts 106 are preferably attached to a plurality of support columns 108 extending down from an overhead supporting structure (not shown) or, in the alternative, support beams (not shown). The slot 100 is located in the part of the track units 32 and 34 which also serves as the second end member 74 of the transverse beam. The end member 74 is widened somewhat at the top so that the placement of the slot 100 in the track units 32 and 34 does not impair the structural integrity of the track 12. Also of note is the placement of the slot 100 vertically above the rail 42 so that downward forces on the rail 42 do not impart a torque on the bolts 106 immediately above the rail 42.

Referring to FIG. 3 in conjunction with FIG. 4, in one form of the present invention a slot 110 is shown formed on each track unit 32 and 34 which extends along the length track 12. The slot 110 is dimensioned to receive and guide a sensing device 112 (visible only in FIG. 3) which is capable of generating position signals corresponding to the position of the carriage 14 on the track 12.

Referring again to FIG. 5, the wheels 20 are shown mounted on the running surface 26 of each track unit 32 and 34, the wheels 20 being inclined at about the same angle with respect to the center upright plate 36 as the rail 42. It should be noted that the wheels 20, as depicted in the various drawings, have identical individual features one with respect to the other, and except for their orientation on the puller carriage 14, are the same. Therefore, while there is shown in FIG. 5 a first wheel 114 and a second wheel 116, only the first wheel 114 will be described in detail, it being understood that such description applies equally to the other wheels 20 depicted in the various embodiments described and illustrated herein, unless otherwise stated.

The first wheel 114 is rotatably mounted on a first inclined support plate 118 extending inwardly from a first inclined side plate 120 of the puller carriage 14. A second inclined support plate 122 extends inwardly from a second inclined side plate 124, and supports the second wheel 116 which is rotatably mounted thereon. The support plates 118 and 122 are essentially mirror images of each other, as are the side plates 120 and 124, the support plates 118 and 122 and the side plates 120 and 124 extending generally along the length of the carriage 14. The support plates 118 and 122 are essentially parallel to the plane of rotation of the wheels 114 and 116 and extend across their width the approximate distance of the smallest diameter of the concave peripheral surfaces 30 of the wheels 20.

First and second shafts 126 and 128 extend through the center of each wheel 114 and 116, respectively, and are oriented lengthwise perpendicular to the plane of rotation made by the wheels 114 and 116. The shafts 126 and 128 are located in the center of the wheels 114 and 116 such that a line made length-wise in the center of the shafts 126 and 128 lies on a line formed by the axis of rotation of the wheels 114 and 116.

Bearing means (not shown) are located between the shafts 126 and 128 and the wheels 114 and 116 and may be attached to the wheels 114 and 116 or free to rotate between the wheels 114 and 116 and the shafts 126 and 128. The shafts 126 and 128 are preferably fixedly attached to the support plates 118 and 122. The wheels 114 and 116 are secured adjacent to the support plates 118 and 116 for rotation about the shafts 126 and 128 by any suitable means. One such means is illustrated in FIG. 5 where the lower ends of the shafts 126 and 128 are threaded to mate with threaded apertures 130 and 132 in the support plates 118 and 116. The top ends of the shafts 126 and 128 have placed thereon heads 134 and 136 for tightening the wheels 114 and 116 and the bearing means into place adjacent to the support plates 118 and 116. Washers 138 and 140 are placed between the heads 134 and 136, respectively, to secure sleeves 142 and 144 against the support plates 118 and 116. The sleeves 142 and 144 are concentrically located around the shafts 126 and 128, respectively, and the bearing means are located between the sleeves 142 and 144 and the wheels 114 and 116. Provision is made in the placement of the bearing means and the sleeves 142 and 144 so that the wheels 114 and 116 do not make contact on their lower surfaces with the support plates 118 and 122 while the wheels 114 and 116 are rotating and subject to upward, downward or lateral forces. The shafts 126 and 128 are of sufficient length to extend through the wheels 114 and 116 and the support plates 118 and 122, and of sufficient thickness and strength to withstand the upward, downward and lateral forces transmitted by the carriage 14.

The first wheel 114 is configured to rotate with a plane of rotation generally parallel to the direction of the rail sides 94 and 96. In the preferred embodiment, the wheel 114 has a concave peripheral surface 144 extending around the circumference of the wheel 114 and extending in the direction of the shaft 126 from the outer surface of the rail side 96 to the outer surface of the rail side 94. Upper and lower rims 146 and 148 extend around the circumference of the wheel 114 on the upper and lower edges of the concave peripheral surface 144. Preferably, the concave surface 144 would mate with the convex running surface 26 on the rail 42 so that the part of the concave surface 144 of the wheel 114 nearest the rail 142 completely engages the running surface 26. In this manner, the planes of rotation of the inner-most edges of the rims 146 and 148 adjacent to the concave surface 144 should pass through and be parallel with the outer surfaces of the rail sides 94 and 96, respectively. The rims 146 and 148 each extend in a direction generally parallel to the shaft 126 away from the concave surface 144 a sufficient distance so that the rims 146 and 146 are thick enough to withstand the upward, downward and lateral forces transmitted from the wheel 114 to the rail 94.

A lower surface 150 of the wheel 114 is adjacent to the support plate 118 and extends generally perpendicular to the shaft 126, and a lower edge 152 of the rim 148 serves as the periphery of the lower surface 150. First, second, and third cylindrical elevations 154, 156 and 158, respectively, are located on the top of the wheel 114 opposite the support plate 118, each elevation being concentric with the shaft 126. The first elevation 154 has the largest diameter and the third elevation 158 has the smallest diameter, the second elevation 156 having a diameter somewhat less than the first elevation 154 and greater than the third elevation 158. Each elevation has a cylindrical side about the same height as the thickness of the rim 146 at its outermost edge so that the elevations form a terraced surface on the top of the wheel 114 up to the sleeve 142. Thusly configured, elevations 154, 156 and 158 provide additional support for the wheel 114 to resist upward forces transmitted by the rail 42.

Figure 2:
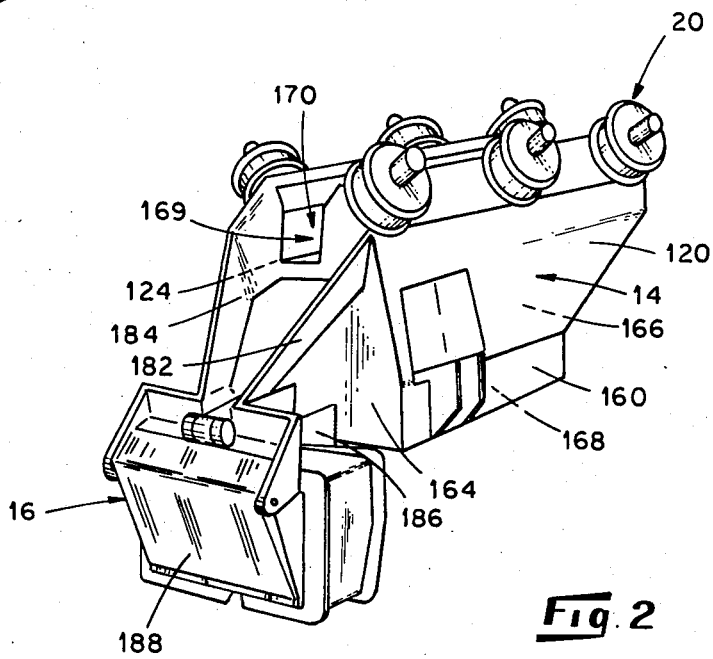
FIG. 2 is a view of the carriage removed from the track and illustrating the orientation and placement of three pairs of inclined wheels on the carriage.
Figure 3:
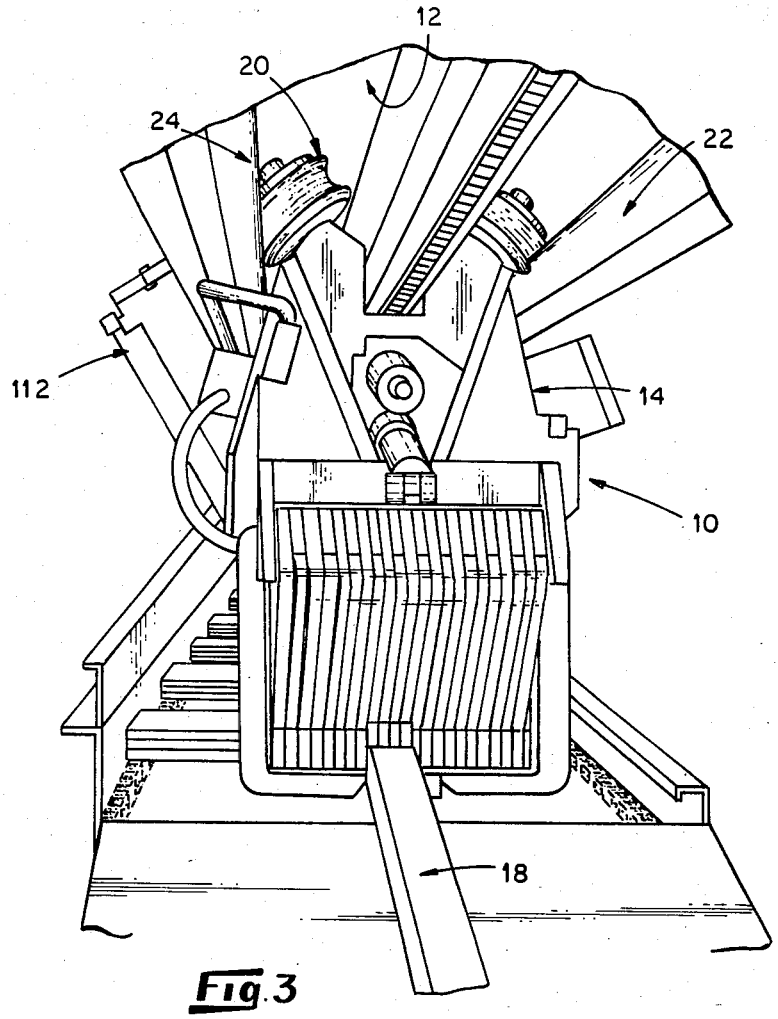
FIG. 3 is a front view illustrating in perspective the mounting of the carriage on the rails below the track.

Referring now to FIG. 5 in conjunction to FIG. 2, in the preferred embodiment the carriage 14 includes the support plates 118 and 122, the side plates 120 and 124, base plates 160 and 162, a front plate 164, a rear plate 166 and a bottom plate 168. The base plates 160 and 162 are generally vertical and extend from the generally horizontal bottom plate 168 upwardly to the side plates 120 and 124, respectively. The front plate 164 extends generally vertically from the bottom plate 168 upwardly to the top of the carriage 14, and has formed in the center of its top a generally rectangular longitudinal opening 169. A generally rectangular and endless opening 170 extends along the length of the carriage 14 parallel to the track 12. A generally horizontal attachment plate 180 extends along the length of the carriage 14, and is vertically located in the carriage so that the center upright plates of the rail units 32 and 34 extend down into the opening 170 sufficient to allow mounting of the chain 56, which is fixedly attached to the carriage 14 in the center of the attachment plate 180, in the lower chain drive 54. The width of the opening 170, and therefore the width of the attachment plate 180, is such that the lower chain guide 54 will not engage vertical edges 172 and 174 of the opening 169 while the carriage is moving along the track 12 or like edges on the rear plate 166. The rear plate 166 has an opening in its top center demensioned and positioned essentially the same as the opening 169 in the front plate 164, and extends initially downward vertically to the approximate height of the attachment plate 180, below which the rear plate 166 extends generally downwardly and toward front of the carriage 14. The upper edges 172 and 174 of the opening 169 in the front plate and like edges on the rear plate 166 are curved outward at the top so that they flushly meet the upper edges 176 and 178 of the inwardly inclined support plates 118 and 122. The carriage 14 is preferably manufactured by welding together the various above described components in essentially the described configuration. The puller jaw 16 is mounted on the front plate 164 by puller arms 182 and 184 and by a support strut 186. Teeth 188 located on the front of the jaw 16 are inclined toward the rear of the carriage 114 and grasp an extrusion profile for being pulled as it emerges from an extruder.

As can be seen in FIG. 2, three pairs of wheels 20 are located on the carriage 14 in the manner described above with respect to the single pair of wheels 20 illustrated in FIG. 5. And it should be noted that the illustrated embodiment of FIG. 5 is not limited by the single pair of wheels 20 shown therein. The disclosure therein contemplates the use of a single pair or a number of pairs of wheels 20, depending on particular requirements. As FIG. 2 reveals, the additional pairs of wheels 20 provide further insurance against undesirable movement of the carriage 14 relative to the extruder while pulling a profile 18. It should be noted that staggering the wheels 20 so they are not located directly across the carriage 14 from each other would also aid in stabilizing the carriage 14 during the extrusion process.

Although particular embodiments of the invention have been described in the foregoing detailed description, it will be understood that the invention is capable of numerous rearrangements, modifications and substitutions of parts without departing from the scope of the invention according to what is claimed below.

What is claimed is:

1. A puller apparatus for pulling an extrusion profile as it emerges from an extruder, comprising:

a track extending away from the extruder in a direction parallel to the extrusion profile;

first and second rails formed on said track in a spaced-apart, opposed parallel relationship and each of said first and second rails extending parallel to said track;

first and second running surfaces formed on said first and second rails, respectively, for bearing a load, each of said running surfaces facing in an inclined upward and inward direction;

a puller carriage carried by said first and second wheels for rolling motion along said track;

a puller jaw mounted on said puller carriage for grasping and pulling the extrusion profile as it emerges from the extruder; and motive means for urging and translating said puller carriage along said track whereby said puller jaw grasps the extrusion profile and said carriage is translated along said track away from the extruder to pull the extrusion profile as it emerges from the extruder.

2. The apparatus of claim 1, wherein said running surfaces are non-planar and said wheels have peripheral surfaces that mate with said running surfaces.

3. The apparatus of claim 1, further comprising means for slidably attaching said motive means to said track and for attaching said motive means to said puller carriage.

4. The apparatus of claim 1, further comprising:

means for supporting said track in a hanging position;

means for attaching said supporting means to said track; and means for sensing the position of said carriage on said track and for generating at least first and second position signals corresponding to at least first and second positions of said carriage on said track.

5. The apparatus of claim 1, further comprising:

means for attaching said motive means to said carriage;

first and second spaced apart, opposed, parallel and inwardly inclined carriage side walls for supporting and attaching said first and second wheels, respectively, to said carriage, said first and second side walls extending parallel to said track along the length of said carriage; and means for rotatably mounting said first and second wheels on said first and second side walls.

6. The apparatus of claim 5, wherein said puller carriage further comprises means defining a longitudinal horizontal groove disposed between said first and second walls, said groove extending parallel to said side walls along the length of said carriage and dimensioned to receive said means for attaching said motive means to said carriage.

7. A puller apparatus for pulling an extrusion profile as it emerges from an extruder, comprising:

a track extending away from the extruder in a direction parallel to the extrusion profile;

first and second rails formed on said track in a spaced-apart, opposed, parallel relationship and each of said first and second rails extending parallel to said track;

first and second semi-cylindrical convex running surfaces having their curvatures facing upwardly and inwardly formed on said first and second rails, respectively, for bearing a load;

at least said first and second wheels inclined at about the same angles as said first and second semi-cylindrical running surfaces, respectively, and being disposed for engaging and rolling on said first and second running surfaces, respectively, each of said first and second wheels having a concave peripheral surface with a semi-circular cross-section dimensioned to engage and mate with said semi-cylindrical convex running surfaces whereby each of said wheels may transmit downwardly and upwardly forces to said running surfaces and may transmit horizontal forces perpendicular to the direction of said track to said running surfaces;

a puller carriage carried by said first and second wheels for rolling motion along said track;

a puller jaw mounted on said puller carriage for grasping and pulling the extrusion profile as it emerges from the extruder; and motive means for urging and translating said puller carriage along said track whereby said puller jaw grasps the extrusion profile and said carriage is translated along said track away from the extruder to pull the extrusion profile as it emerges from the extruder.

8. A puller apparatus for pulling an extrusion profile as it emerges from an extruder, comprising:

a track extending away from the extruder in a direction parallel to the extrusion profile;

first and second rails formed on said track in a spaced-apart, opposed, parallel relationship and each of said first and second rails extending parallel to said track;

said track comprising first and second track units extending along the length of said track, said first track unit being a mirror image of said second track unit, each of said first and second track units comprising:

a center upright plate extending along the length of said track;

a transverse beam extending along the length of said track and, across the transverse beam's width, extending outwardly from adjacent the top edge of said center upright plate in a direction generally perpendicular to said center upright plate; and an outer beam extending along the length of said track and, across the outer beam's width, extending generally downwardly from the outer edge of said transverse beam;

said first and second rails being oriented facing upwardly and toward said center upright plates from the lower edges of said outer beams of said first and second track units, respectively;

said upright plates of said first and second track units being mounted in a side-by-side relationship to form said track;

first and second upwardly and inwardly facing running surfaces formed on said first and second rails, respectively, for bearing a load;

at least first and second wheels configured to engage and roll on said first and second running surfaces, respectively;

a puller carriage carried by said first and second wheels for rolling motion along said track;

a puller jaw mounted on said puller carriage for grasping and pulling the extrusion profile as it emerges from the extruder; and motive means for urging and translating said puller carriage along said track whereby said puller jaw grasps the extrusion profile and said carriage is translated along said track away from the extruder to pull the extrusion profile as it emerges from the extruder.

9. The apparatus of claim 8, wherein said track further comprises means for slidably attaching said motive means to said track, said means for attaching being disposed generally along the lower edges of said upright plates and horizontally along the length of said track.

10. A puller apparatus for pulling an extrusion profile as it emerges from an extruder, comprising:

a generally horizontal track extending away from the extruder in a direction parallel to the extrusion profile;

said track comprising first and second track units extending along the length of said track, said first track unit being a mirror image of said second track unit and said first and second track units being mounted in a parallel side-by-side adjacent relationship to form said track;

first and second rails formed on said first and second track units, respectively, in a spaced apart, opposed, parallel relationship, said first and second rails extending parallel to said track;

first and second running surfaces formed on said first and second rails, respectively, for bearing a load, said running surfaces having semi-cylindrical peripheral surfaces facing upwardly and inwardly and extending along the length of said rails;

puller carriage for being moved along said track;

means for mounting said puller carriage for motion along said track;

a puller jaw mounted on said puller carriage for grasping and pulling an extrusion profile as it emerges from the extruder;

motive means for urging and translating said puller carriage along said track whereby said puller jaw grasps an extrusion profile and said carriage is translated along said track away from the extruder to pull the extrusion profile as it emerges from the extruder; and means for supporting said track in a hanging position.

11. The apparatus of claim 10, further comprising upper and lower guides disposed along the upper and lower surfaces of said first and second track units, respectively, said upper and lower guides configured to receive said motive means.

12. The apparatus of claim 10, wherein said track further comprises support slots disposed in the upper surfaces of said first and second track units for receiving said supporting means, said slots extending along the length of said track.

13. The apparatus of claim 10, wherein said means for mounting said puller carriage comprises:

a plurality of wheels rotatably mounted on said carriage; and said wheels configured to engage and roll on said first and second running surfaces.

14. The apparatus of claim 10, wherein each of said first and second track units comprises:

a center upright plate extending along the length of said track;

a transverse beam extending along the length of said track and, across the transverse beam's width, extending outwardly from adjacent the top of said center upright plate in a direction generally perpendicular to said center upright plate;

an outer beam extending along the length of said track and, across the outer beam's width, extending generally downwardly from the outer end of said transverse beam; and said rail facing upwardly and toward the point where said transverse beam extends from said center upright plate.

15. The apparatus of claim 14, wherein said transverse beam further comprises a support slot formed adjacent the outward end of said transverse beam at a point generally vertically above said rail for receiving said supporting means, said support slot extending along the length of said track.

16. The apparatus of claim 14, further comprising:

means for sensing the position of said carriage on said track and for generating at least first and second positon signals corresponding to at least first and second positions of said carriage on said track; and a slot formed in the outer surface of said outer beam for receiving and guiding said means for sensing, said slot extending along the length of said track.

17. The apparatus of claim 14, wherein said transverse beam comprises:

a first transverse section extending widthwise generally upwardly and outwardly from said center upright plate;

said first transverse section having upper and lower spaced apart, generally parallel members and being enclosed at its outward end by a first end member generally perpendicular to said upper and lower members;

a second transverse section extending widthwise outwardly from said first section of said transverse beam; and said second transverse section having upper and lower spaced apart, generally parallel members and being enclosed at its inward end by said first end member and enclosed at its outer end by a second end member generally perpendicular to said upper and lower members of said second section.

18. The apparatus of claim 17, wherein said outer beam comprises:

a first outer section extending widthwise downwardly and outwardly from said second end member of said transverse beam;

said first outer section having inner and outer spaced apart members, said inner and outer members being enclosed at their top by said second end of member of said transverse beam and enclosed at their bottom by a lower end member approximately perpendicular to said center upright plate;

a second outer section extending downwardly from said first outer section;

said second outer section being essentially triangular in cross section and having an inner side generally coplanar with said inner member of said first outer section and an outer side extending downwardly and inwardly, said inner and outer sides of said second outer section enclosed at the top by said lower end member of said first outer section; and said inner and outer sides joined together at their lower edges to form a junction.

19. The apparatus of claim 18, wherein said rail comprises:

a rail base extending widthwise from said junction downwardly and inwardly, and being essentially coplanar with said outer side of said second section of said outer beam;

a pair of spaced apart, generally parallel rail sides extending widthwise upwardly and inwardly toward said transverse beam from opposite edges of said rail base; and said running surface extending widthwise between the upper edges of said rail sides, the transition between said rail sides and said running surface forming a generally smooth rounded surface.

20. A puller apparatus for pulling an extrusion profile as it emerges from an extruder, comprising:

a track extending away from the extruder in a direction parallel to the extrusion profile;

first and second rails formed on said track in a spaced apart, opposed, parallel ralationship and each of said first and second rails extending parallel to said track;

first and second upwardly and inwardly facing running surfaces formed on said first and second rails, respectively, for bearing a load, said running surfaces being semi-cylindrical and convex with their curvatures facing upwardly and inwardly;

a first wheel pair configured and disposed to engage and roll on said first and second running surfaces;

a second wheel pair configured and disposed to engage and roll on said first and second running surfaces;

a puller carriage carried by said wheels for rolling motion along said track;

a puller jaw mounted on said puller carriage for grasping and pulling the extrusion profile as it emerges from the extruder; and means for urging and translating said puller carriage along said track to pull the extrusion profile as it emerges from the extruder.

21. The apparatus of claim 20, wherein said wheels have concave peripheral surfaces that mate with the semi-cylindrical convex running surfaces.

22. The apparatus of claim 20, further comprising means for supporting said track at positions vertically above each of said rails whereby a downward force on one of said rails will not impart a torque on said supporting means immediately above each of said rails.

23. The apparatus of claim 20, further comprising:

each of said wheels comprising a concave peripheral surface having a semi-circular cross section dimensioned to engage and mate with said semi-cylindrical convex running surfaces whereby each of said wheels may transmit downwardly and upwardly forces to said running surfaces and horizontal forces perpendicular to the direction of said track to said running surfaces; and said wheels inclined at about the same angles as said first and second semi-cylindrical running surfaces.

24. The apparatus of claim 23, wherein each of said first and second wheel pairs comprise two spaced apart, opposed wheels, said wheels inclined one with respect to the other at an approximately 90 degree angle.

25. The apparatus of claim 20, further comprising a third wheel pair configured and disposed to engage and roll on said first and second running surfaces.

26. The apparatus of claim 25, wherein said wheels have concave peripheral surfaces that mate with the convex running surface.

27. The apparatus of claim 25, further comprising each of said wheels comprising a concave peripheral surface having a semi-circular cross section dimensioned to engage and mate with said semi-cylindrical convex running surfaces whereby each of said wheels may transmit downwardly and upwardly forces to said running surfaces and horizontal forces perpendicular to the direction of said track to said running surfaces; and said wheels inclined at about the same angles as said first and second semi-cylindrical running surfaces.

28. The apparatus of claim 27, wherein each of said first, second and third wheel pairs comprise two spaced apart, opposed wheels, said wheels inclined one with respect to the other at an approximately 90 degree angle.

* * * * *